US005870123A

United States Patent [19]

Lorenze, Jr. et al.

[11] Patent Number: 5,870,123

[45] Date of Patent: Feb. 9, 1999

[54] INK JET PRINTHEAD WITH CHANNELS FORMED IN SILICON WITH A (110) SURFACE ORIENTATION

[75] Inventors: Robert V. Lorenze, Jr., Webster; James F. O'Neill, Penfield, both of N.Y.

[73] Assignee: Xerox Corporation, Stamford, Conn.

[21] Appl. No.: 679,977

[22] Filed: Jul. 15, 1996

[51] Int. Cl.[6] ..... B41J 2/05; B41J 2/16

[52] U.S. Cl. ..... 347/65; 216/27

[58] Field of Search ..... 347/65, 63, 56, 347/54, 20; 216/27, 2, 33, 36, 56, 99

[56] References Cited

U.S. PATENT DOCUMENTS

| | | | |
|---|---|---|---|
| 4,047,184 | 9/1977 | Bassous et al. | 346/75 |
| 4,216,477 | 8/1980 | Matsuda | 347/70 |
| 4,312,008 | 1/1982 | Taub et al. | 346/140 R |
| 4,418,472 | 12/1983 | Lorenze, Jr. | 29/603 |
| 4,472,875 | 9/1984 | Christian et al. | 29/577 |
| 4,600,934 | 7/1986 | Aine et al. | 357/26 |
| 4,601,777 | 7/1986 | Hawkins | 347/63 X |
| 4,611,219 | 9/1986 | Sugitani et al. | 347/65 |
| 4,612,554 | 9/1986 | Poleshuk | 346/140 R |
| 4,812,199 | 3/1989 | Sickafus | 156/626 |
| 4,966,037 | 10/1990 | Sumner et al. | 73/204.26 |
| 5,096,535 | 3/1992 | Hawkins et al. | 156/633 |
| 5,282,926 | 2/1994 | Trah et al. | 156/647 |
| 5,484,507 | 1/1996 | Ames | 156/644.1 |
| 5,502,471 | 3/1996 | Obermeier et al. | 347/65 |
| 5,524,784 | 6/1996 | Shiba et al. | 347/65 |
| 5,582,678 | 12/1996 | Komuro | 216/27 |
| 5,697,144 | 12/1997 | Mitani et al. | 347/65 |

FOREIGN PATENT DOCUMENTS

| | | | |
|---|---|---|---|
| 6-183008 | 7/1994 | Japan | B41J 2/05 |

*Primary Examiner*—Joseph Hartary
*Attorney, Agent, or Firm*—R. Hutter

[57] ABSTRACT

In an ink-jet printhead, the individual channels for ejecting ink onto a print medium are orientation dependently etched along the (111) planes perpendicular to the (110) surface orientation of a single crystal silicon wafer. The silicon wafer is bonded on a glass substrate to act as both a support and an etch stop in the etching process. The orientation of the channels within the silicon layer facilitates channels which are rectangular in cross section.

11 Claims, 3 Drawing Sheets

INK JET PRINTHEAD WITH CHANNELS FORMED IN SILICON WITH A (110) SURFACE ORIENTATION

FIELD OF THE INVENTION

The present invention relates to a printhead for a thermal ink-jet printer, in which the ink ejector channels are formed in a (110) plane of a single crystal silicon wafer, bonded to a silicate glass substrate.

BACKGROUND OF THE INVENTION

In thermal ink-jet printing, droplets of ink are selectably ejected from a plurality of drop ejectors in a printhead. The ejectors are operated in accordance with digital instructions to create a desired image on a print medium moving past the printhead. The printhead may move back and forth relative to the sheet in a typewriter fashion, or the linear array may be of a size extending across the entire width of a sheet, to place the image on a sheet in a single pass.

The ejectors typically comprise capillary channels, or other ink passageways, which are connected to one or more common ink supply manifolds. Ink is retained within each channel until, in response to an appropriate digital signal, the ink in the channel is rapidly heated by a heating element disposed on a surface within the channel. This rapid vaporization of the ink adjacent the channel creates a bubble which causes a quantity of liquid ink to be ejected through an opening associated with the channel to the print medium. One patent showing the general configuration of a typical ink-jet printhead is U.S. Pat. No. 4,774,530, assigned to the assignee in the present application.

DESCRIPTION OF THE PRIOR ART

In the prior art, U.S. Pat. No. 5,502,471 discloses an ink-jet printhead made from a silicon wafer. FIGS. 5*a–c* and 6*a–c* in said patent show steps of anisotropic etching of a silicon wafer up to an etch stop.

U.S. Pat. No. 5,484,507 discloses an etching process in which an etched aperture in a silicon substrate is aligned with the crystal plane of the silicon.

U.S. Pat. No. 5,282,926 discloses a method of etching wafers. Hexagonal openings are made in a mask layer, each hexagonal opening having two edges parallel to the [100] direction and four edges parallel to [110] directions located at right angles to one another.

U.S. Pat. No. 5,096,535 discloses a process for manufacturing channel structures in an ink-jet printhead. Under this technique, rectangular structures must be aligned to the [110] direction on the (100) silicon plane.

U.S. Pat. No. 4,966,037 discloses fabrication of three-dimensional microstructures by etching of silicon.

U.S. Pat. No. 4,812,199 discloses a "deflectable element" formed from a silicon wafer. FIG. 2 shows the silicon wafer being oriented with its main surface in the (110) plane.

U.S. Pat. No. 4,612,554 discloses a high density thermal ink-jet printhead in which the substantially triangular channels are formed by anisotropic etching of silicon.

U.S. Pat. No. 4,600,934 discloses a semiconductor structure in which cavities are etched in silicon, the side edge of the cavities being disposed at an angle most nearly parallel to the [111] traces on the face which is being etched, which is typically the (100) plane.

U.S. Pat. No. 4,472,875 discloses a method for manufacturing a thermal printhead through etching of a silicon wafer having a [100] crystalline orientation.

U.S. Pat. No. 4,418,472 discloses a process of etching structures in the (110) plane of crystal silicon.

U.S. Pat. No. 4,312,008 discloses an impulse jet head formed by etching of a silicon substrate.

U.S. Pat. No. 4,047,184 discloses a charge electrode array for use in an ink-jet printing apparatus formed by anisotropic etching of aperture through a single crystal silicon substrate of (110) orientation. The array thus formed creates a funnel-shaped aperture open at both ends.

SUMMARY OF THE INVENTION

According to one aspect of the present invention, there is provided an ink-jet printhead comprising a substrate defining a main surface. A single crystal silicon wafer is bound to the main surface of the substrate, the silicon wafer being oriented with a (110) plane parallel to the main surface of the substrate. A plurality of parallel channels are defined in the silicon wafer, with a portion of the main surface of the substrate being exposed within each channel.

According to another aspect of the present invention, there is provided a method of making an ink-jet printhead. A substrate defining a main surface is provided. A single crystal silicon wafer is bonded to the main surface of the substrate, the silicon wafer being oriented with the (110) plane parallel to the main surface of the substrate. A plurality of parallel channels are created in the silicon wafer with a portion of the main surface of the substrate being exposed within each channel.

BRIEF DESCRIPTION OF THE DRAWINGS

In the drawings:

FIG. 1 is a cross sectional view through a portion of an ink-jet printhead according to the present invention, showing a plurality of capillary channels illustrated end-on defined in the printhead. A substrate, indicated as 10, defines a main surface, indicated as 11, on which is disposed a patterned silicon wafer indicated as 12. The substrate 10 is preferably of an etch-resistant material, such as a silicate glass, preferably silicon dioxide. As shown in FIG. 1, the silicon wafer 12 has a number of channels, indicated as 14, defined therein; these parallel channels are shown end-on in FIG. 1 and correspond to the capillary channels through which ink is ejected in the printhead. Exposed within each channel 14 is a heating element 16. The various heating elements 16 are in turn defined on a heater chip 20, the basic design of which is known in the art, particularly as relevant to "side-shooter" thermal ink-jet printers.

DETAILED DESCRIPTION OF THE INVENTION

Figure 1:
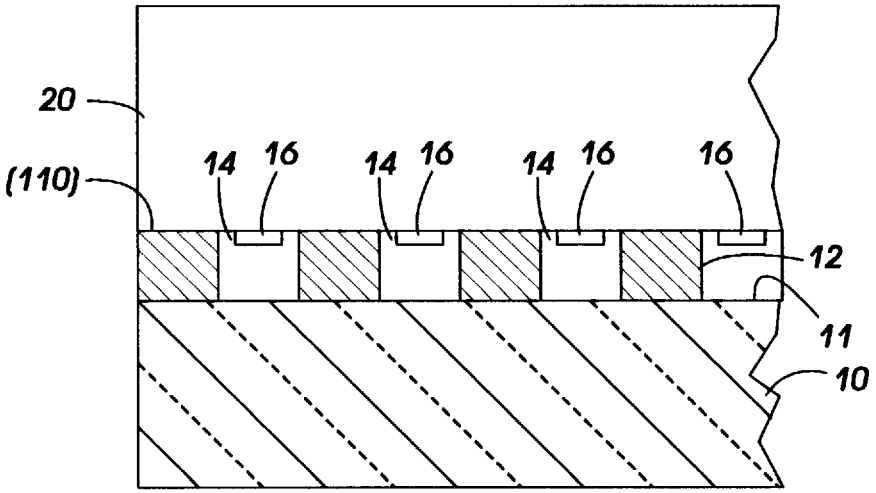
FIG. 1 is a cross sectional view of a portion of an ink-jet printhead according to the present invention.

Thus, each channel 14 defined in the printhead has exposed therein a portion of the main surface 11 of glass substrate 10, the heating element 16 and other surfaces associated with heater chip 20, and, forming the wall between each individual channel 14, a portion of the silicon material 12. These four walls define the channel 14 of each ejector. Subsequent printhead fabrication processes will define both a nozzle end and an ink supply end to the channel structures.

Significantly, according to the present invention, the orientation of the crystalline silicon wafer 12 is such that the (110) crystal plane of the silicon wafer 12 is parallel to the main surface 11 of the glass substrate 10. By providing the silicon layer 12 with its (110) crystal plane parallel to the main surface 11 of glass substrate 10, the channels 14 which are subsequently etched in the silicon wafer 12 will have sidewalls which are substantially perpendicular to the main surface 11 of substrate 10. In combination with the heater chip 20, these perpendicular sidewalls contribute to a substantially square or rectangular cross-section of each channel 14. Having a square profile of each channel is desirable both from the perspective of structural integrity of the entire printhead, in that a relatively large surface area is provided for an adhesive bonding of heater chip 20 to silicon layer 12, and also from the perspective of more accurate directionality of ink drops ejected from these higher symmetry square profile channels 14.

Figure 2:
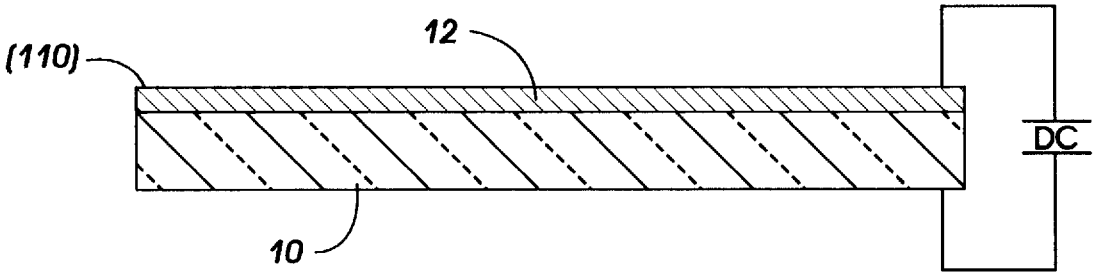
FIGS. 2–4 are a series of cross sectional views showing successive steps in a technique according to the present invention of making an ink-jet printhead.
Figure 3:
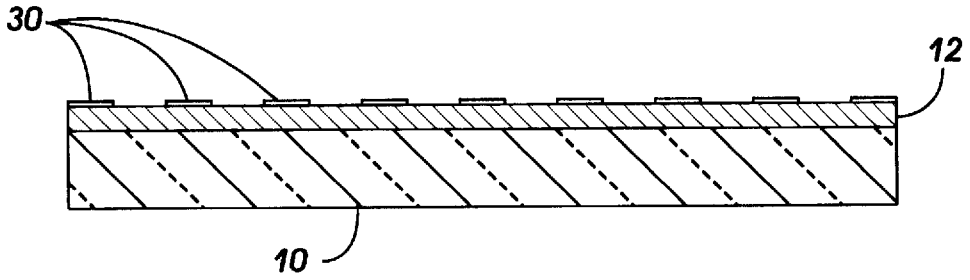
Figure 4:
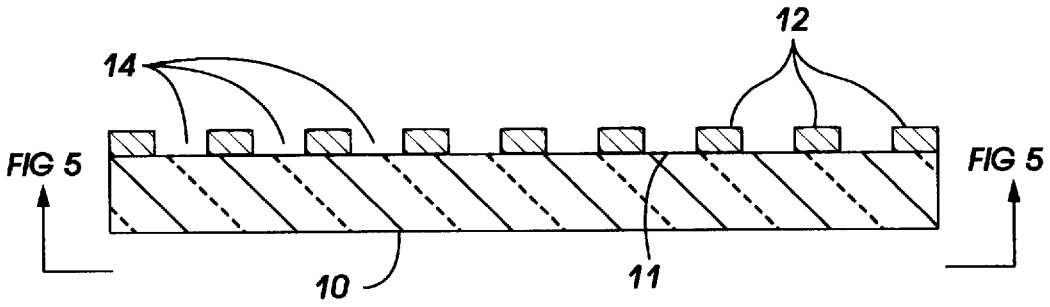

FIGS. 2–4 are a series of cross sectional views showing the preferred technique for creation of an ink-jet printhead such as shown in FIG. 1. In the first step, illustrated in FIG. 2, there is provided the glass substrate 10, with the silicon wafer 12 bonded to a main surface thereof. Several techniques are available for bonding the silicon wafer 12 to glass substrate 10, but according to a preferred embodiment of the invention, the two layers are bonded together by a "field assisted thermal bonding" technique, also called anodic or electrostatic bonding. According to this procedure, the glass substrate 10 is placed in contact with the silicon wafer 12, and the resulting assembly is heated to a temperature of about 400 degrees C. At this high temperature, a high voltage potential, typically from 1000 to 1500 volts DC, is applied across the interface. Within minutes a high strength, permanent, hermetic seal is achieved between the glass and silicon via permanent chemical bonds. Once this bonding is achieved, the channels 14 may be etched in the silicon layer 12, although it may be desirable at this point to thin the silicon layer 12 down to a certain thickness; this thinning can be accomplished by known techniques of electro-mechanical, chem-mechanical, or mechanical polishing.

FIG. 3 shows a subsequent step in the technique of the present invention, in which a mask layer 30 preferably of silicon nitride is applied and photolithographically defined on the top surface of layer 12 as shown, in a configuration corresponding to the desired location of the channel 14. In a preferred embodiment of the present invention, the orientation of the channels, such as provided by mask layer 30, should be in patterns aligned to the (111) planes of the silicon wafer 12. Once the mask layer 30 is patterned, an orientation dependent etching process can be used to etch the silicon. A number of etchants can be used, such as tetramethyl ammonium hydroxide, hydrazine, ethylene diamine, pyrocatechol/water, or KOH. In a preferred technique, a KOH/water solution (15–45 wt % KOH) is used at a temperature in the range of 60°–100° C. Under these conditions, a typical silicon etch rate is approximately 4 microns per minute, but is very sensitive to etchant temperature and concentration.

FIG. 4 shows the assembly at the end of the etching process, and after the removal of masking layer 30. One practical disadvantage of chemical etching in the illustrated (110) orientation is that while the sidewalls can be made parallel to each other, the bottom of the "trench" formed by chemical etching of pure silicon in this manner tends to be uneven; however, in the present invention, the non-etchable substrate 10 provides the desirable even bottom to the channel 14. It will be noted that the main surface 11 of glass substrate 10 acts as a uniform etch stop to the etching process, so that every channel 14 has a "flat bottom" as shown in the Figures. At this point, the heater chip 20, as shown in FIG. 1, can be bonded by adhesive to the remaining top surfaces of silicon wafer 12, to obtain the final product as shown in FIG. 1.

Figure 5:
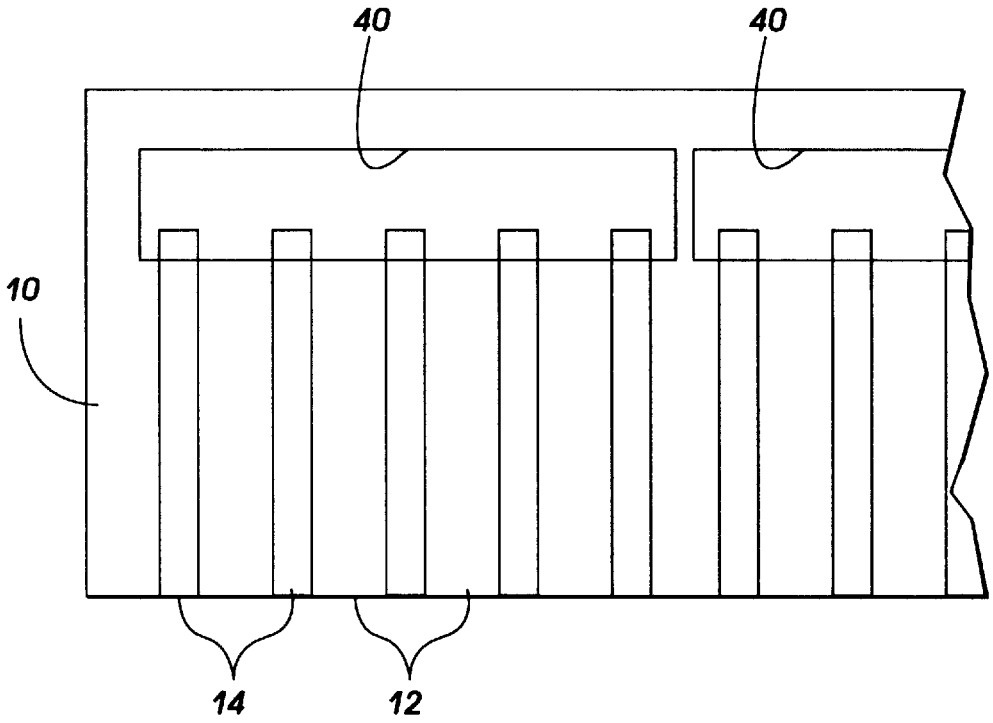
FIG. 5 is a plan view of a portion of an ink-jet printhead as viewed through the view marked 5 in FIG. 4.

FIG. 5 is a plan view of a portion of a printhead made according to the present invention, shown through the view marked 5 in FIG. 4. Because the glass layer 10 can be made transparent, such a view as in FIG. 5 can reveal the channels 14 formed in silicon layer 12, all bound to the glass layer 10. Further shown in FIG. 5 are apertures 40 which can be defined in the glass substrate 10, which overlap with one end of each channel 14. These openings 40 can be used, in the finished printhead, as input ports or manifolds connected to a liquid ink supply (not shown) for loading liquid ink into the channels 14 as needed. (Although two apertures 40 are shown in the Figure, each aperture 40 accessing five channels 14, in a practical embodiment of the printhead there may be any number of apertures, and each aperture can access any number of channels.) The apertures 40 can be created in the substrate 10 even before the attachment of silicon wafer 12 thereto. Optionally, the silicon orientation dependent etching mask 30 can incorporate a contiguous reservoir pattern. This would permit an ink reservoir structure to be etched into the silicon simultaneously with the channel structures 14, thus connecting one end of each channel to a common fluid (ink) supply. These reservoir structures can be aligned under the ink inlet apertures formed in the glass substrate.

Among the practical advantages of the present invention are the ability to create ink channels with a rectangular cross section. As mentioned above, a rectangular cross section increases the amount of available surface area for bonding the silicon wafer 12 to the heater chip 20, and permits a design environment in which the relative height and width of the profiles of channels 14 can be manipulated for an optimum design. It may be desirable, for example, to provide channels 14 which are not so much square, as illustrated, but more toward elongated rectangles, for purposes of, for example, close packing of high-density channels in a linear array, or to accommodate the butting of several individual printhead chips into a larger printhead. Further, the transparency of the glass substrate 10 facilitates both visual alignment of the channels 14 with the heating elements 16 in heater chip 20. The transparency of substrate 10 also permits visual observation of the behavior of individual ejectors in action, which may be useful for detecting failure of individual ejectors.

While the invention has been described with reference to the structure disclosed, it is not confined to the details set forth, but is intended to cover such modifications or changes as may come within the scope of the following claims.

We claim:

1. An ink-jet printhead comprising:

a substrate defining a main surface;

a single crystal silicon wafer bonded to the main surface of the substrate, the silicon wafer being oriented with a (110) plane parallel to the main surface of the substrate; and a plurality of parallel channels defined in the silicon wafer, with a portion of the main surface of the substrate being exposed within each channel, wherein each parallel channel defines sidewalls in the silicon wafer which are perpendicular to the main surface of the substrate.

2. The printhead of claim 1, wherein the substrate comprises a silicate glass.

3. The printhead of claim 2, wherein the silicate glass is silicon dioxide.

4. The printhead of claim 1, further comprising a heater chip disposed adjacent the parallel channels, the heater chip defining a plurality of heating elements, each of the plurality of heating elements being disposed in a parallel channel.

5. The printhead of claim 1, wherein the parallel channels are parallel to a (111) plane of the single crystal silicon wafer.

6. The printhead of claim 1, further comprising an aperture defined in the substrate, the aperture accessing a parallel channel in the silicon wafer.

7. A method of making an ink-jet printhead, comprising the steps of providing a substrate defining a main surface;

bonding a single crystal silicon wafer to the main surface of the substrate, the silicon wafer being oriented with a (110) plane parallel to the main surface of the substrate; and creating a plurality of parallel channels in the silicon wafer, with a portion of the main surface of the substrate being exposed within each channel.

8. The method of claim 7, wherein the bonding step includes the steps of heating the substrate and the silicon wafer to a predetermined temperature; and applying an electrical field across the substrate and the silicon wafer.

9. The method of claim 7, wherein the creating step includes the step of chemically etching the parallel channels in the silicon wafer.

10. The method of claim 7, wherein the substrate comprises silicon dioxide.

11. The method of claim 7, wherein the parallel channels are created parallel to (111) planes of the single crystal silicon wafer.

* * * * *